US005284279A

United States Patent [19]

Sason et al.

[11] Patent Number: 5,284,279

[45] Date of Patent: Feb. 8, 1994

[54] BACKPACK

[75] Inventors: Dan Sason, Kochav Yair; Ziv Orovan, Hinanit, both of Israel

[73] Assignee: Modan Industries (1983) Ltd., Tel Aviv, Israel

[21] Appl. No.: 835,276

[22] Filed: Feb. 13, 1992

[51] Int. Cl.[5] ..... A45F 3/04

[52] U.S. Cl. ..... 224/209; 224/215; 224/202

[58] Field of Search ..... 224/209, 210, 211, 213, 224/214, 215, 216, 259, 260, 261, 262, 263, 202, 205, 208; 24/171, 196, 308

[56] References Cited

FOREIGN PATENT DOCUMENTS

| | | | |
|---|---|---|---|
| 351333 | 1/1990 | European Pat. Off. | 224/213 |
| 3605532 | 8/1987 | Fed. Rep. of Germany | 224/213 |
| 2670096 | 6/1992 | France | 224/211 |
| 9105494 | 5/1991 | PCT Int'l Appl. | 224/213 |
| 667195 | 9/1988 | Switzerland | 224/213 |
| 678796 | 11/1991 | Switzerland | 224/211 |

*Primary Examiner*—Henry J. Recla
*Assistant Examiner*—Glenn T. Barrett
*Attorney, Agent, or Firm*—Ladas & Parry

[57] ABSTRACT

A backpack having an article carrier; a waist belt attached to the article carrier and arranged for fastening the article carrying apparatus about the waist of a user; shoulder supports arranged for fastening the article carrier about an upper body portion of the user; and apparatus for attaching the shoulder supports to the article carrier and including apparatus for adjusting the position of attachment of the shoulder supports to the article carrier so as to selectably increase and decrease the distance between a position of attachment of the shoulder supports to the article carrier relative to the position of attachment of the waist belt to the article carrier while the backpack is being worn by the user.

18 Claims, 3 Drawing Sheets

BACKPACK

FIELD OF THE INVENTION

The present invention relates to backpacks.

BACKGROUND OF THE INVENTION

Backpacks have been known for many years as a convenient means of carrying loads on the back of a person while leaving his hands free. Backpacks are most typically used by military personnel in the field and by mountaineers and hikers.

A modern backpack is typically equipped with adjustable shoulder supports and a waist belt, both attached to the main pouch, or to a frame associated therewith, so as to most efficiently and comfortably locate the backpack on the back of a user. It has been recognized, however, as being desirable to enable adjustment of the position of the shoulder supports relative to the waist belt so as to fit the backpack with maximum comfort onto the back of a person.

One type of backpack on the market employs adjustable length straps for attaching the shoulder supports to the main pouch frame. A further type of backpack on the market employs a generally vertical track to which the shoulder supports are attached, the position of the shoulder supports being determined by tightening of a screw so as to fix them in a selected position. A disadvantage of the systems employed by these two backpacks is that the distance between the shoulder supports and the waist belt cannot be adjusted while the backpack is located on a person's back.

A further backpack on the market employs a shoulder support adjustment system wherein the shoulder supports are attached via adjustable straps to a track mounted on an adjacent portion of the pouch. While this system permits a reduction in the distance between the shoulder supports and the waist belt while the backpack is being worn, the back pack must be removed from the back of the wearer in order to increase the shoulder support-waist belt distance. A further disadvantage of this backpack is that it is properly supported on the back only when the weight of the load being carried in the backpack is predominantly exerted in the direction of the hips, or down the back. If the wearer of the backpack bends over forwards, however, the backpack tends to slip off the back.

SUMMARY OF THE INVENTION

The present invention seeks to provide a system for enabling adjustment of the distance between the shoulder supports and the waist belt of a backpack while the backpack is being worn, wherein the system also provides support to a load being carried in the backpack, regardless of the orientation thereof.

There is provided, therefore, in accordance with an embodiment of the invention, a backpack having an article carrier; a waist belt attached to the article carrier and arranged for fastening the article carrying apparatus about the waist of a user; shoulder supports arranged for fastening the article carrier about an upper body portion of the user; and apparatus for attaching the shoulder supports to the article carrier and including apparatus for adjusting the position of attachment of the shoulder supports to the article carrier so as to selectably increase and decrease the distance between a position of attachment of the shoulder supports to the article carrier relative to the position of attachment of the waist belt to the article carrier while the backpack is being worn by the user.

Additionally in accordance with an embodiment of the invention, the adjustment apparatus includes a track mounted onto the article carrier; a sliding buckle attached to the shoulder supports and configured for sliding along the track, and having a body portion and first and second buckle portions; a first elongate, flexible fastening element attached to the article carrier and extending through the buckle in association with the fist buckle portion; and a second elongate, flexible fastening element attached to the article carrier and extending through the buckle in association with the second buckle portion, the body portion and the first and second buckle portions being configured to cooperate so as to selectably lock together the buckle and either of the first and second flexible fastening elements, thereby locking together the shoulder supports and the article carrier.

Further in accordance with an embodiment of the invention, the body portion is attached to the shoulder supports and defines first and second openings through which the first and second flexible fastening elements respectively extend. In addition, the first buckle portion is arranged in association with the first opening such that the first flexible fastening element extends through the first opening tangentially to the first buckle portion and thereabout so as to form a first loop between the first buckle portion and the body portion, and back out through the first opening; and the second buckle portion is arranged in association with the second opening such that the second flexible fastening element extends through the second opening tangentially to the second buckle portion and thereabout so as to form a second loop between the second buckle portion and the body portion, and back out through the second opening.

Additionally in accordance with an embodiment of the invention, the backpack also includes apparatus enabling a predetermined displacement of the first buckle portion relative to the body portion in response to at least a predetermined force applied via the first flexible fastening element, the predetermined displacement causing entrapment of the first loop between the first buckle portion and the body portion, thereby locking the first flexible fastening element to the buckle, and thereby also locking together the shoulder supports and the article carrier.

Further in accordance with an embodiment of the invention, the apparatus enabling a predetermined displacement of the first buckle portion also includes apparatus enabling a predetermined displacement of the second buckle portion relative to the body portion in response to at least a predetermined force applied via the second flexible fastening element, the predetermined displacement causing entrapment of the second loop between the second buckle portion and the body portion, thereby locking the second flexible fastening element to the buckle, and thereby also locking together the shoulder supports and the article carrier.

Additionally in accordance with an embodiment of the invention, the adjustment apparatus also includes apparatus for slidably mounting the first and second buckle portions within the body portion of the buckle, which apparatus includes a resilient compression member for applying a predetermined locking force, via the first buckle portion, so as to lockably engage a portion of the first flexible fastening element between the first buckle portion and the body portion, thereby enabling the second flexible fastening element, in the absence of the predetermined force being applied therealong, to be pulled through the buckle by the user, thereby increasing the distance between the position of attachment of the shoulder supports to the article carrier relative to the position of attachment of the waist belt to the article carrier, application to the resilient member of a force greater than the predetermined locking force and in an opposite direction thereto causing the second flexible fastening element to be freed from locking engagement with the first buckle portion and the body portion, thereby enabling movement of the second elongate flexible element through the buckle so as to decrease decreasing the distance between the position of attachment of the shoulder supports to the article carrier relative to the position of attachment of the waist belt to the an article carrier.

In accordance with a further embodiment of the invention, there is provided a backpack having article carrier; shoulder supports arranged for fastening the article carrier about an upper body portion of the user; and apparatus for attaching the shoulder supports to the article carrier and including apparatus for adjusting the position of attachment of the shoulder supports to the article carrier while the backpack is being worn by the user.

The adjustment apparatus includes a track mounted onto the article carrier; a sliding buckle attached to the shoulder supports and configured for sliding along the track, and having a body portion and first and second buckle portions; a first elongate, flexible fastening element attached to the article carrier and extending through the first buckle portion; and a second elongate, flexible fastening element attached to the article carrier and extending through the second buckle portion, wherein the body portion and the first and second buckle portions are configured to cooperate so as to selectably lock together the buckle and either of the first and second flexible fastening elements, thereby locking together the shoulder supports and the article carrier.

BRIEF DESCRIPTION OF THE DRAWINGS

The present invention will be more fully understood and appreciated from the following detailed description, taken in conjunction with the drawings, in which.

DETAILED DESCRIPTION OF A PREFERRED EMBODIMENT

Figure 1B:
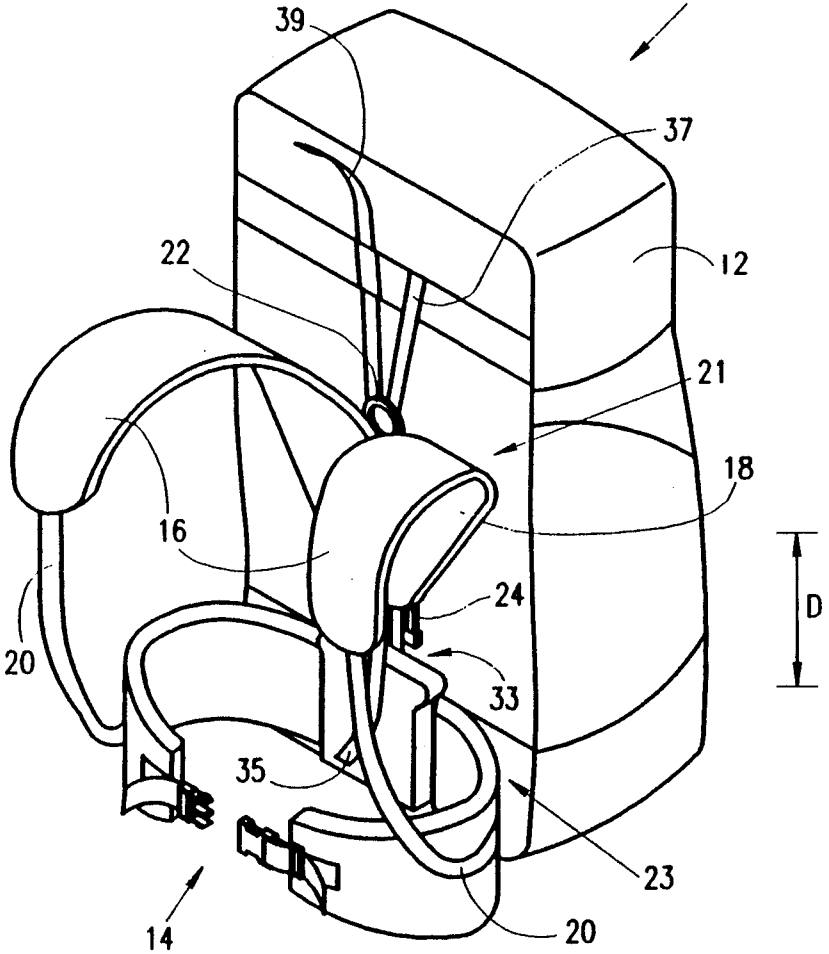
FIG. 1B is a general view of the backpack illustrated in FIG. 1A, wherein the shoulder support-waist belt distance has been adjusted to a minimum.
Figure 1A:
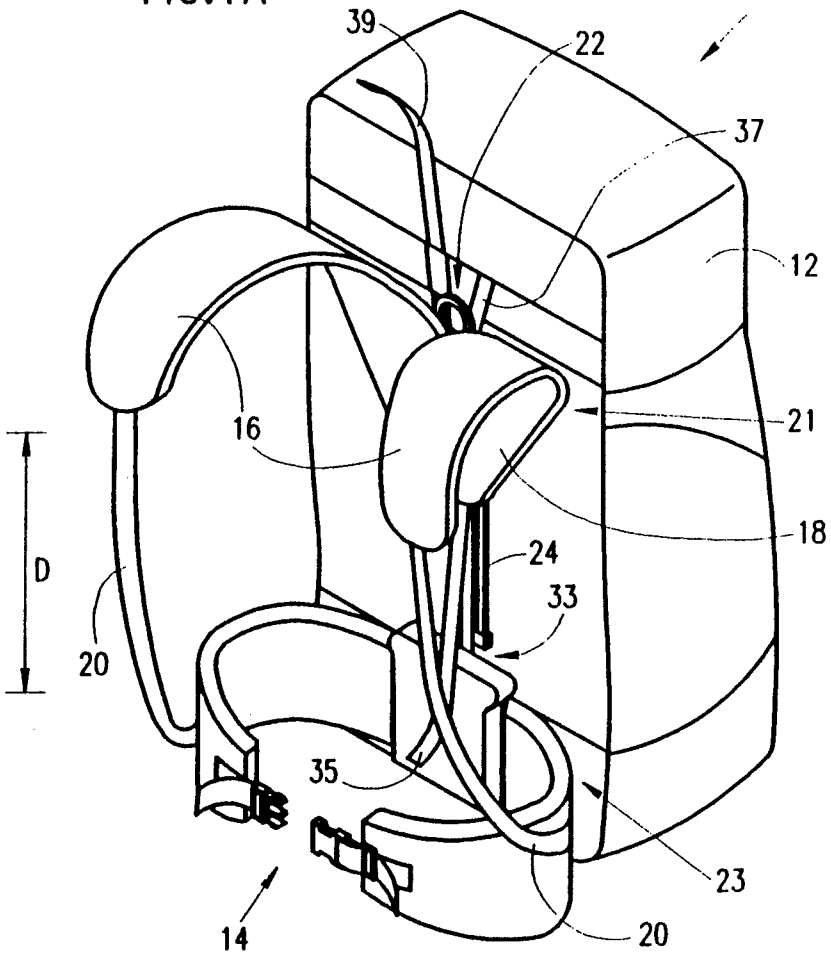
FIG. 1A is a general view of a backpack employing a system for adjusting the distance between shoulder supports and a waist belt of the backpack in accordance with the present invention, wherein the shoulder support-waist belt distance is illustrated at a maximum.
Figure 2C:
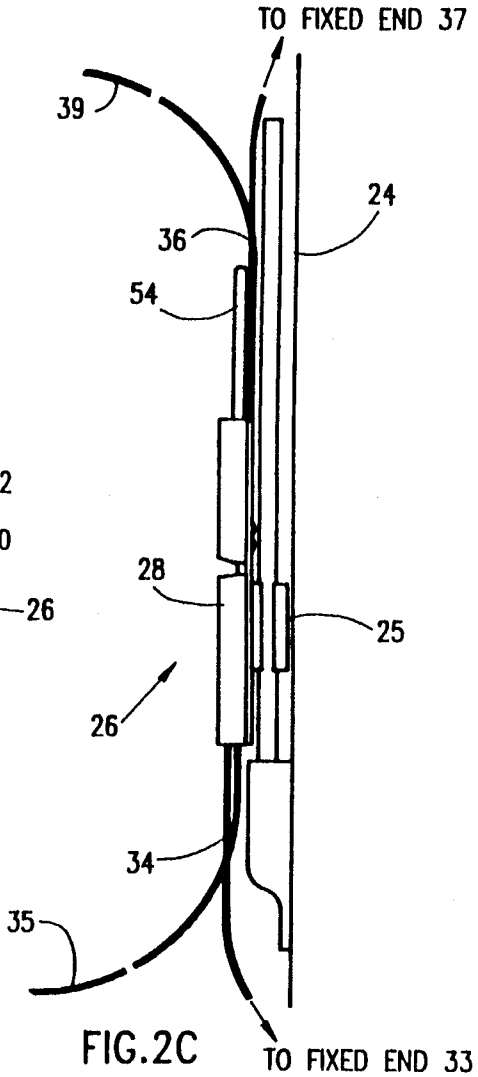
FIG. 2C is a side view of the track-mounted sliding strap buckle illustrated in FIG. 2B.
Figure 2B:
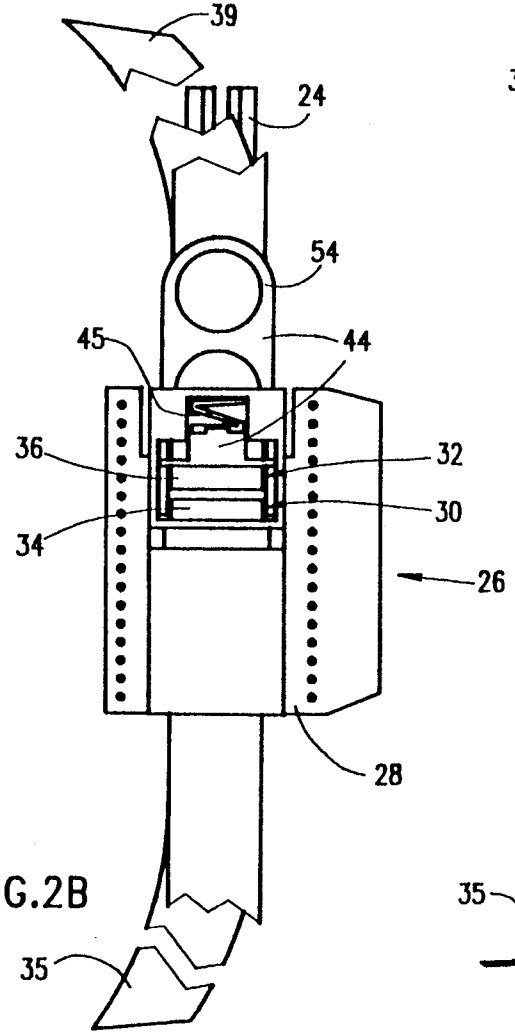
FIG. 2B is a front view of the track-mounted sliding strap buckle illustrated in FIG. 2A.
Figure 2A:
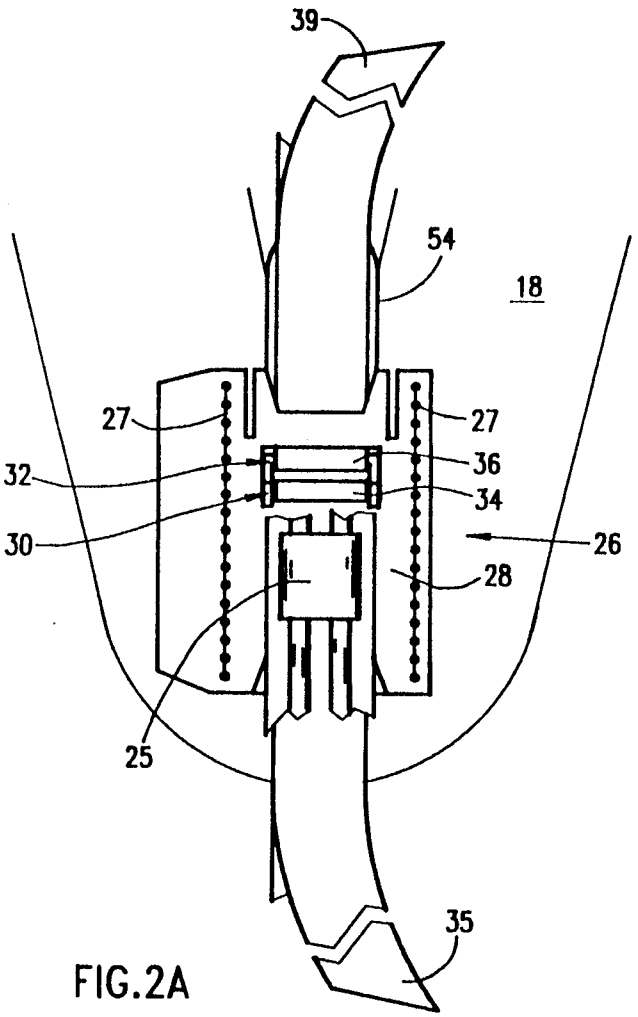
FIG. 2A is a rear view of a nape pad and track-mounted sliding strap buckle forming part of the shoulder support-waist belt distance adjustment system of the present invention.

Reference is now made to FIGS. 1A and 1B in which is illustrated a backpack 10 constructed in accordance with a preferred embodiment of the invention. The backpack 10 includes a generally pouch-shaped article carrying portion 12, a waist belt 14 and shoulder supports 16. The waist belt 14 is attached by any suitable means to the carrying portion 12 and is arranged for fastening the carrying portion 12 to the waist of a user.

The shoulder supports 16 are arranged for fastening the carrying portion 12 to the upper body of a user and are, in the present example, integrally formed so as to define, at a first end, a nape portion 18. Shoulder supports 16 also include straps 20 which are attached, as by stitching, to a rear portion of the waist belt 14.

The shoulder supports 16 are attached, via adjustable attachment apparatus, referenced generally 22, to the carrying portion 12. As described in more detail below in conjunction with FIGS. 2A-3B, adjustable attachment apparatus 22 enables adjustment, while the backpack 10 is being worn by the user, of the shoulder supports 16 relative to the carrying portion 12 so as to selectably increase and decrease the distance 'D' between a position 21 of attachment of the shoulder supports 16 to the carrying portion 12 relative to a position 23 of attachment of the waist belt 14 to the carrying portion 12.

In FIG. 1A distance D is illustrated at a maximum, while distance D is illustrated at a minimum in FIG. 1B.

Referring now to FIGS. 2A-3B, adjustment apparatus 22 includes a track 24 (also FIGS. 1A and 1B) mounted onto the carrying portion 12; a sliding buckle 26 attached via a rigid body portion 28, as by stitching 27 (FIG. 2A) to nape portion 18 of shoulder supports 16. Buckle 26 is configured for sliding, via a track engagement portion 25, along the track 24, and has first and second rod-like buckle portions, respectively referenced 30 and 32.

Apparatus 22 further includes a first elongate, flexible fastening strap 34 attached via a first end 33 to the carrying portion 12 and extending through buckle 26 in association with the first buckle portion 30 so as to define a free, second end 35; and a second elongate, flexible fastening strap 36 attached via a first end 37 to the carrying portion 12 and extending through buckle 26 in association with the second buckle portion 32 so as to define a free, second end 39.

As will be appreciated from the ensuing description, the body portion 28 of buckle 26 and the first and second buckle portions 30 and 32 are configured to cooperate so as to selectably lock together the buckle 26 and either of the first and second straps 34 and 36, thereby locking together the shoulder supports 16 to the carrying portion 12 at a selected position along track 24.

Figure 3A:
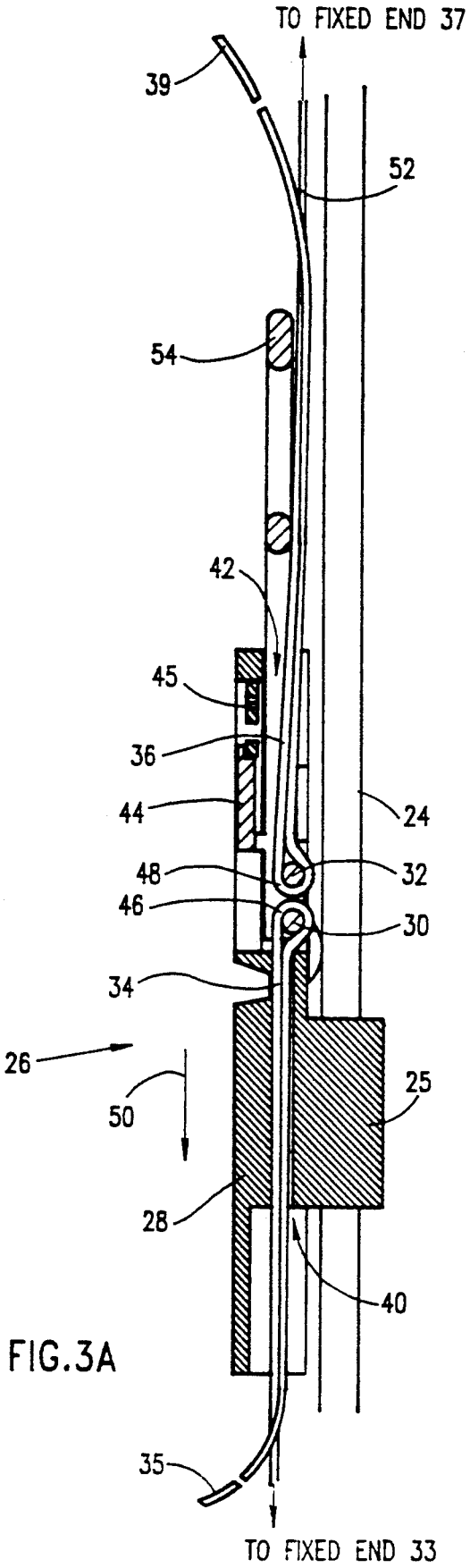
FIG. 3A is an enlarged cross-sectional view of the buckle and straps illustrated in FIGS. 2A-2C, wherein the buckle and lower strap are locked together.
Figure 3B:
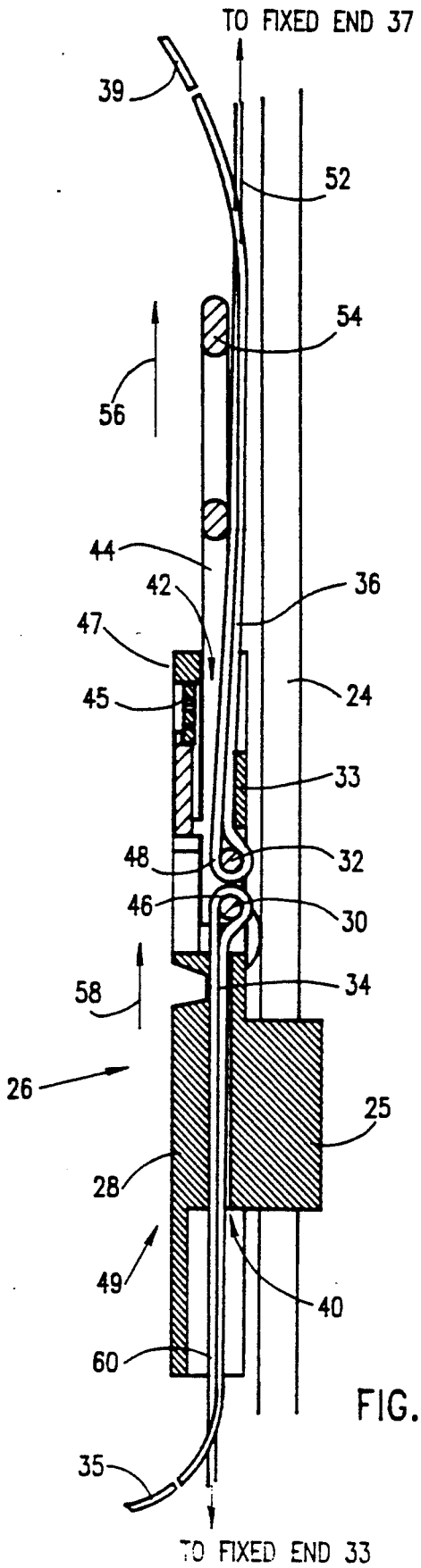
FIG. 3B is a cross-sectional view corresponding to FIG. 3A, but wherein the lower strap has been released from the buckle, thereby permitting an increase in the shoulder support-waist belt distance.

As illustrated in detail in FIGS. 3A and 3B, body portion 28 of buckle 26, which is attached to nape portion 18, and defines first and second openings, respectively referenced 40 and 42 through which the first and second straps 34 and 36 extend respectively. The first and second buckle portions 30 and 32 are mounted onto a generally planar, elongate member 44 which is mounted so as to extend through second opening 42 and such that the buckle portions are positioned within a central space formed in body portion 28. Planar member 44 includes a ring-like handle portion 54, the function of which is described below.

In particular, first buckle portion 30 is arranged across first opening 40 but laterally displaced therefrom, such that, from free end 35 to fixed end 33, the first opening 40 tangentially to first buckle portion 30 and circumferentially thereabout so as to form a loop 46, between the first buckle portion 30 and the body portion 28, and back out through the first opening 40.

Similarly, second buckle portion 32 is arranged across second opening 42 but laterally displaced therefrom, such that, from free end 39 to fixed end 37, the second strap 36 extends along the following path: through the second opening 42 tangentially to second buckle portion 32 and circumferentially thereabout so as to form a loop 48 between the second buckle portion 32 and the body portion 28, and back out through second opening 42.

Planar member 44 is mounted within buckle 26 so as to be displaceable relative thereto, thereby causing a similar displacement of buckle portions 30 and 32 and, correspondingly, a displacement of loops 46 and 48. As illustrated, a resilient compression member 45 is provided between planar member 44 and a second end portion 47 of body portion 28, thereby applying a force to planar member 44 in the general direction of a first end 49 of body portion 28.

In the position illustrated in FIG. 3A, wherein buckle 26 is generally vertical, such that a tension force is applied to first strap 34 in the direction indicated by arrow 50, loop 46 of the first strap 34 becomes entrapped between first buckle portion 30 and body portion 28, thereby locking the first strap 34 to the buckle 26, and thereby also locking together the shoulder supports 16 and the carrying portion 12 in the indicated position. In this position, as the clearance between second buckle portion 32 and body portion 28 is sufficiently large, second strap 36 may be pulled, via its free end 39, so as to shorten a portion 52 of second strap 36 between its fixed end 37 and buckle 26, thereby causing an upward movement of buckle 26 relative to fixed end 37 so as to increase the distance D between the respective locations of attachment of shoulder supports 16 and waist belt 14 to carrying portion 12 (FIGS. 1A and 1B).

Referring now particularly to FIG. 3B, a displacement of planar member 44 via handle 54, away form buckle 26 in the direction indicated by arrow 56, causes a corresponding displacement of the first and second buckle portions 30 and 32, indicated by arrows 58.

The described displacement causes loop 46 of first strap 34 to be freed from its hitherto entrapped position and causes loop 48 of second strap 36 to become entrapped between second buckle portion 32 and an adjacent portion of body portion 28, thereby locking second strap 36 to the buckle 26. In this situation, due to the freeing of first strap 34, the weight of the carrying portion 12 (FIGS. 1A and 1B) or of a load being carried thereby causes first strap 34 to be paid through the buckle 26, thereby lengthening a portion 60 of first strap 34 between its fixed end 33 and buckle 26, thus enabling generally upward movement of buckle 26 along track 24, relative to waist belt 14, so as to lengthen the distance D.

It will thus be appreciated that, as the distance between the respective attachment locations of shoulder supports 16 and waist belt 14 to carrying portion 12 may be adjusted either by pulling strap 35 (shortening) or by pulling strap 39 (lengthening), any adjustments required in the shoulder support-waist belt distance may be effected without having to first remove the backpack 10.

A further feature of the invention is that application of a tension force to portion 52 of second strap 36 will not cause its movement through buckle 26 due to the entrapment of loop 48 between second buckle portion 32 and an adjacent portion 33 of body portion 28. Accordingly, if, when being worn, backpack 10 is tipped such that its load is applied in the direction of an upper portion 62 of carrying portion 12 (FIGS. 1A and 1B), second strap 36 functions as a load-bearing element, and, due to the locking thereof with buckle 26, slipping of the backpack over the shoulders of the user is prevented.

It will be appreciated by persons skilled in the art that the present invention is not limited by what has been described hereinabove by way of example. The scope of the invention is limited, rather, solely by the claims which follow.

We claim:

1. A backpack comprising:

article carrying means:

a waist belt attached to said article carrying means and arranged for fastening said article carrying means about the waist of a user and defining a position of attachment of said waist belt to said article carrying means;

shoulder support means arranged for fastening said article carrying means about an upper body portion of the user and defining a position of attachment of said shoulder support means to said article carrying means; and means for attaching said shoulder support means to said article carrying means and including means for adjusting the position of attachment of said shoulder support means to said article carrying means so as to selectably increase and decrease a distance between the position of attachment of said shoulder support means to said article carrying means relative to the position of attachment of said waist belt to said article carrying means while said backpack is being worn by the user, said means for adjusting including first and second elongate flexible fastening means connected to said shoulder support means, whereby application of tension to a first one of said first and second elongate flexible fastening means causes said distance to increase and application of tension to a second one of said first and second elongate flexible fastening means causes said distance to decrease.

2. A backpack according to claim 1 and wherein said means for adjusting comprises:

track means mounted onto said article carrying means;

sliding buckle means attached to said shoulder support means and configured for sliding along said track means, and having a body portion and first and second buckle portions; and wherein said first elongate, flexible fastening means is attached to said article carrying means and extends through said buckle means in association with said first buckle portion; and said second elongate, flexible fastening means is attached to said article carrying means and extends through said buckle means in association with said second buckle portion, and wherein said body portion and said first and second buckle portions are configured to cooperate so as to selectably lock together said buckle means and at least one of said first and second flexible fastening means, thereby locking together said shoulder support means and said article carrying means.

3. A backpack according to claim 2, and wherein said body portion is attached to said shoulder means and defines first and second openings through which said first and second flexible fastening means respectively extend, and wherein said first buckle portion is arranged in association with said first opening such that said first flexible fastening means extends through said first opening tangentially to said first buckle portion and thereabout so as to form a loop between said first buckle portion and said body portion, and back out through said first opening, and said second buckle portion is arranged in association with said second opening such that said second flexible fastening means extends through said second opening tangentially to said first buckle portion and thereabout so as to form a loop between said second buckle portion and said body portion, and back out through said second opening.

4. A backpack according to claim 3, and also comprising means enabling a predetermined displacement of said first buckle portion relative to said body portion in response to at least a predetermined force applied via said first flexible fastening means, said predetermined displacement causing entrapment of said first loop between said first buckle portion and said body portion, thereby locking said first flexible fastening means to said buckle means, and thereby also locking together said shoulder support means and said article carrying means.

5. A backpack according to claim 4, and wherein said means enabling a predetermined displacement of said first buckle portion also includes means enabling a predetermined displacement of said second buckle portion relative to said body portion in response to at least a predetermined force applied via said second flexible fastening means, said predetermined displacement causing entrapment of said second loop between said second buckle portion and said body portion, thereby locking said second flexible fastening means to said buckle means, and thereby also locking together said shoulder support means and said article carrying means.

6. A backpack according to claim 5, and wherein said means for adjusting also comprises means for slidably mounting said first and second buckle portions within said body portion of said buckle means, said means for slidably mounting also including resilient compression means for applying a predetermined locking force, via said first buckle portion, so as to lockably engage a portion of said first flexible fastening means between said first buckle portion and said body portion, thereby enabling said second flexible fastening means, in the absence of said predetermined force being applied therealong, to be pulled through said buckle means by the user, thereby increasing the distance between the position of attachment of said shoulder support means to said article carrying means relative to the position of attachment of said waist belt to said article carrying means, application to said resilient means of a force greater than said predetermined locking force and in an opposite direction thereto causing said second flexible fastening means to be freed from locking engagement with said first buckle portion and said body portion, thereby enabling movement of said second elongate flexible means through said buckle means so as to decrease the distance between the position of attachment of said shoulder support means to said article carrying means relative to the position of attachment of said waist belt to said article carrying means.

7. A backpack according to claim 6, and wherein said means for slidably mounting also includes handle means for applying to said resilient means a force greater than said predetermined locking force, thereby causing said freeing of said second flexible fastening means.

8. A backpack comprising:

article carrying means;

shoulder support means arranged for fastening said article carrying means about an upper body portion of the user and defining a position of attachment of said shoulder support means to said article carrying means; and means for attaching said shoulder support means to said article carrying means and including means for adjusting the position of attachment of said shoulder support means to said article carrying means while said backpack is being worn by the user, said means for adjusting comprising track means mounted onto said article carrying means;

sliding buckle means attached to said shoulder support means and configured for sliding along said track means, and having a body portion and first and second buckle portions;

first elongate, flexible fastening means attached to said article carrying means and extending through said buckle means in association with said first buckle portion; and second elongate, flexible fastening means attached to said article carrying means and extending through said buckle means in association with said second buckle portion, and wherein said body portion and said first and second buckle portions are configured to cooperate so as to selectably lock together said buckle means and at least one of said first and second flexible fastening means, thereby locking together said shoulder support means and said article carrying means, and wherein application of tension to said first or second elongate flexible fastening means is operative to unlock said shoulder support means and said article carrying means and to change the relative positions thereof.

9. A backpack according to claim 8, and wherein said body portion is attached to said shoulder support means and defines first and second openings through which said first and second flexible fastening means respectively extended, and wherein said first buckle portion is arranged in association with said first opening such that said first flexible fastening means extends through said first opening tangentially to said first buckle portion and thereabout so as to form a first loop between said first buckle portion and said body portion, and back out through said first opening, and said second buckle portion is arranged in association with said second opening such that said second flexible fastening means extends through said second opening tangentially to said second buckle portion and thereabout so as to form a second loop between said second buckle portion and said body portion, and back out through said second opening.

10. A backpack according to claim 9, and also comprising means enabling a predetermined displacement of said first buckle portion relative to said body portion in response to at least a predetermined force applied via said first flexible fastening means, said predetermined displacement causing entrapment of said first loop between said first buckle portion and said body portion, thereby locking said first flexible fastening means to said buckle means, and thereby also locking together said shoulder support means and said article carrying means.

11. A backpack according to claim 10, and wherein said means enabling a predetermined displacement of said first buckle portion also includes means enabling a predetermined displacement of said second buckle portion relative to said body portion in response to at least a predetermined force applied to via said second flexible fastening means, said predetermined displacement causing entrapment of said second loop between said second buckle portion and said body portion, thereby locking said second flexible fastening means to said buckle means, and thereby also locking together said shoulder support means and said article carrying means.

12. A backpack according to claim 11, and wherein said means for adjusting also comprises means for slidably mounting said first and second buckle portions within said body portions of said buckle means, said means for slidably mounting also including resilient compression means for applying a predetermined locking force, via said first buckle portion, so as to lockably engage a portion of said first flexible fastening means between said first buckle portion and said body portion, thereby enabling said second flexible fastening means, in the absence of said predetermined force being applied therealong, to be pulled through said buckle means by the user, thereby displacing the position of attachment of said shoulder support means to said article carrying means in a first direction, application to said resilient means of a force greater than said predetermined locking force and in an opposite direction thereto causing said first flexible fastening means to be freed from locking engagement with said first buckle portion and said body portion, thereby enabling movement of said second elongate flexible means through said buckle means so as to displace the position of attachment of said shoulder support means to said article carrying means in a second direction.

13. A backpack according to claim 12, and wherein said means for slidably mounting also includes handle means for applying to said resilient means a force greater than said predetermined locking force, thereby causing said freeing of said second flexible fastening means.

14. A backpack according to claim 8, and also comprising a waist belt attached to said article carrying means and arranged for fastening said article carrying means about the waist of the user.

15. Apparatus for use with a backpack having a shoulder support for adjustably attaching the shoulder support to the backpack comprising:

track means mounted onto said backpack;

sliding buckle means attached to the shoulder support and configured for sliding along said track means, and having a body portion and first and second buckle portions;

first elongate, flexible fastening means attached to said backpack and extending through said buckle means in association with said first buckle portion; and second elongate, flexible fastening means attached to said backpack and extending through said buckle means in association with said second buckle portion, and wherein said body portion and said first and second buckle portions are configured to cooperate so as to selectably lock together said buckle means and at least one of said first and second flexible fastening means, thereby locking together said shoulder support and the backpack, wherein application of tension to said first or second elongate flexible fastening means is operative to unlock said shoulder support and said backpack and to change the relative positions thereof.

16. Apparatus according to claim 15, and wherein said body portion is attached to the shoulder support and defines first and second openings through which said first and second flexible fastening means respectively extend.

and wherein said first buckle portion is arranged in association with said first opening such that said first flexible fastening means extends through said first opening tangentially to said first buckle portion and thereabout so as to form a first loop between said first buckle portion and said body portion, and back out through said first opening, and said second buckle portion is arranged in association with said second opening such that said second flexible fastening means extends through said second opening tangentially to said second buckle portion and thereabout so as to form a second loop between said second buckle portion and said body portion, and back out through said second opening.

17. Apparatus according to claim 16, and also comprising means enabling a predetermined displacement of said first buckle portion relative to said body portion in response to at least a predetermined force applied via said first flexible fastening means, said predetermined displacement causing entrapment of said first loop between said first buckle portion and said body portion, thereby locking said first flexible fastening means to said buckle means, and thereby also locking together the shoulder support and the backpack.

18. Apparatus according to claim 17, and wherein said means enabling a predetermined displacement of said first buckle portion also includes means enabling a predetermined displacement of said second buckle portion relative to said body portion in response to at least a predetermined force applied via said second flexible fastening means, said predetermined displacement causing entrapment of said second loop between said second buckle portion and said body portion, thereby locking said second flexible fastening means to said buckle means, and thereby also locking together the shoulder support and the backpack.

* * * * *